US009218918B2

(12) United States Patent
Lauraire et al.

(10) Patent No.: US 9,218,918 B2
(45) Date of Patent: Dec. 22, 2015

(54) SINGLE POLE SWITCHING UNIT AND SWITCHGEAR DEVICE COMPRISING ONE SUCH UNIT

(71) Applicant: Schneider Electric Industries SAS, Rueil-Malmaison (FR)

(72) Inventors: Michel Lauraire, Sant Maur des Fosses (FR); Didier Vigouroux, Brignoud (FR)

(73) Assignee: SCHNEIDER ELECTRIC INDUSTRIES SAS, Rueil-Malmaison (FR)

( * ) Notice: Subject to any disclaimer, the term of this patent is extended or adjusted under 35 U.S.C. 154(b) by 86 days.

(21) Appl. No.: 14/204,167

(22) Filed: Mar. 11, 2014

(65) Prior Publication Data

US 2014/0262708 A1 Sep. 18, 2014

(30) Foreign Application Priority Data

Mar. 15, 2013 (FR) ..... 13 52343

(51) Int. Cl.

*H01H 1/20* (2006.01)
*H01H 1/22* (2006.01)
*H01H 9/38* (2006.01)

(Continued)

(52) U.S. Cl.

CPC ..... *H01H 1/2016* (2013.01); *H01H 1/2025* (2013.01); *H01H 9/38* (2013.01); *H01H 9/302* (2013.01); *H01H 9/443* (2013.01)

(58) Field of Classification Search

CPC ..... H01H 1/20; H01H 1/2016; H01H 1/2083; H01H 1/26

USPC ..... 200/447, 284, 441, 243, 237, 16 A, 200/50.33, 50.36

See application file for complete search history.

(56) References Cited

U.S. PATENT DOCUMENTS 4,216,358 A * 8/1980 Brozille ..... H01H 13/365 200/240
4,216,452 A * 8/1980 Arnoux ..... H01H 1/26 200/243

(Continued)

FOREIGN PATENT DOCUMENTS

DE 1 089 846 9/1960
DE 20 22 178 A1 11/1971

(Continued)

OTHER PUBLICATIONS

French Preliminary Search Report issued Dec. 3, 2013 in French Application 13 52343, filed on Mar. 15, 2013 (with English Translation of Categories of Cited Documents).

*Primary Examiner* — Renee Luebke
*Assistant Examiner* — Ahmed Saeed
(74) *Attorney, Agent, or Firm* — Oblon, McClelland, Maier & Neustadt, L.L.P.

(57) ABSTRACT

A single-pole switching unit including electrical switching having two stationary contacts and a moving contact including a bridge having two ends each able to cooperate with a stationary contact. The moving contact includes a first branch and a second branch designed to connect the two stationary contacts, respectively and being movable relative to one another. The first branch is separated from the stationary contacts, while the second branch is still in contact with said stationary contacts when the contacts are opened. The second branch is in contact with the stationary contacts, while the first branch is separated from the contacts when the contacts are closed.

9 Claims, 4 Drawing Sheets

(51) Int. Cl.
*H01H 9/30* (2006.01)
*H01H 9/44* (2006.01)

(56) References Cited

U.S. PATENT DOCUMENTS 4,262,179 A * 4/1981 Bauer ..... H01H 1/20 200/243
4,347,415 A * 8/1982 Falchi ..... H01H 3/001 200/243
4,401,863 A * 8/1983 Lemmer ..... H01H 50/546 200/16 A
4,401,867 A * 8/1983 Grunst ..... H01H 3/001 200/243
4,421,959 A * 12/1983 Chen ..... H01H 9/38 200/16 A
6,310,528 B1 10/2001 Kuboyama et al.
6,861,595 B2 * 3/2005 Passow ..... H01H 1/2008 200/16 A
2015/0022292 A1 * 1/2015 Tachikawa ..... H01H 50/54 335/131

FOREIGN PATENT DOCUMENTS

EP 0 100 699 A1 2/1984
FR 2 794 282 A1 12/2000

* cited by examiner

Cross-section BB

SINGLE POLE SWITCHING UNIT AND SWITCHGEAR DEVICE COMPRISING ONE SUCH UNIT

TECHNICAL FIELD OF THE INVENTION

The invention relates to a single-pole switching unit comprising electrical switching means comprising:

- two stationary contacts respectively connected to an electrical pad for connecting to said unitary unit;
- a moving contact including a bridge having a body elongated along the longitudinal axis and having two ends each able to cooperate with a stationary contact in a closed position of the contacts of said unit.

The single-pole switching unit further includes a device for actuating the moving contact including a moving contact holder.

The invention also relates to an electrical switchgear device including at least one unitary current switching unit.

BACKGROUND OF THE INVENTION

Contactors are generally sized to perform a large number of maneuvers establishing and interrupting the current in a charge. However, some are not used for this type of application, but rather as current circulators with a small number of maneuvers for establishing and interrupting the current. This is for example the case for contactors used in combination with a speed regulator as the short-circuiting element for the regulator or to provide galvanic insulation.

In that case, the sizing of the contactor is not currently optimized for that purpose. In fact, the electrical contact pads of a contactor used for this type of application are generally oversized, the volume of those electrical contact pads being provided to perform a large number of maneuvers. This oversizing may cause additional costs of the installation. Furthermore, the "current passage line" of the contactor is also not optimized to guarantee maximal passage of a continuous current in a minimal volume. The "current passage line" refers to the assembly formed by the stationary contacts associated with the moving contact.

BRIEF DESCRIPTION OF THE INVENTION

The invention therefore aims to resolve the drawbacks of the state of the art, so as to propose a switching unit including effective and compact switching means.

The moving contact of the electrical switching means of the single-pole switching unit according to the invention includes a first branch and a second branch designed to connect the two stationary contacts in the closed position of the contacts, respectively. The first and second branches are movable relative to one another such that:

the first current passage branch is separated from the two stationary contacts, while the second branch is still in contact with said stationary contacts when the contacts of said unit are opened;

the second current switching branch is in contact with the two stationary contacts, while the first branch is separated from the stationary contacts when the contacts of said unit are closed.

According to one embodiment of the invention, the first passage branch is mounted translatably on the moving contact holder between two so-called contact pressure positions, a first contact pressure spring applying a first contact pressure force. The second switching branch is mounted translatably on the contact holder movable between two so-called contact pressure positions, a second contact pressure spring applying a second contact pressure force.

Preferably, the first and second branches include substantially parallel longitudinal axes that are offset relative to one another in a movement direction of the moving contact, the movement being a translatable movement in a direction perpendicular to the longitudinal axis.

According to one advantageous embodiment of the invention, the two stationary contacts are in the shape of a J at the contact areas with the second branch, such that, in the closed position of the contacts, the direction of the electrical current circulating in a stationary contact is opposite the direction of the electrical current circulating in the second branch.

According to one advantageous embodiment of the invention, the two stationary contacts have a straight shape at the contact areas with the first branch, such that the direction of the electrical current circulating in a stationary contact is identical to the direction of the electrical current circulating in the first branch.

Advantageously, the single-pole switching unit includes two first current passage branches driven so as to go simultaneously from their open position to their closed position and vice versa, said first branches being arranged parallel to one another.

Preferably, each first branch is mounted translatably on the moving contact holder between two so-called contact pressure positions, a first contact pressure spring applying a first contact pressure force on each first branch.

According to one advantageous embodiment of the invention, the first and second branches respectively comprise two ends including a contact area capable of cooperating with a contact area of a stationary contact (320).

Advantageously, the contact areas of the second branch include a contact pad and the contact areas of the stationary contact designed to be in contact with the contact areas of the second branch include a contact pad.

Advantageously, the contact areas of the first branch and the contact areas of the stationary contact designed to be in contact with the contact areas of the first branch are respectively covered with a layer of silver or silver carbon.

According to one particular embodiment of the invention, the moving contact holder includes a magnetic U having two branches arranged such that they extend in the direction of movement to surround at least part of the first branches.

The switchgear device according to the invention includes a phase unit comprising at least one single-pole switching unit controlled by an actuating unit acting on actuating devices of the unitary phase units for synchronized control of the opening of the contacts.

BRIEF DESCRIPTION OF THE FIGURES

Other advantages and features will appear more clearly from the following description of specific embodiments of the invention, provided as non-limiting examples, and illustrated in the appended drawings, in which.

DETAILED DESCRIPTION OF THE INVENTION

Figure 1:
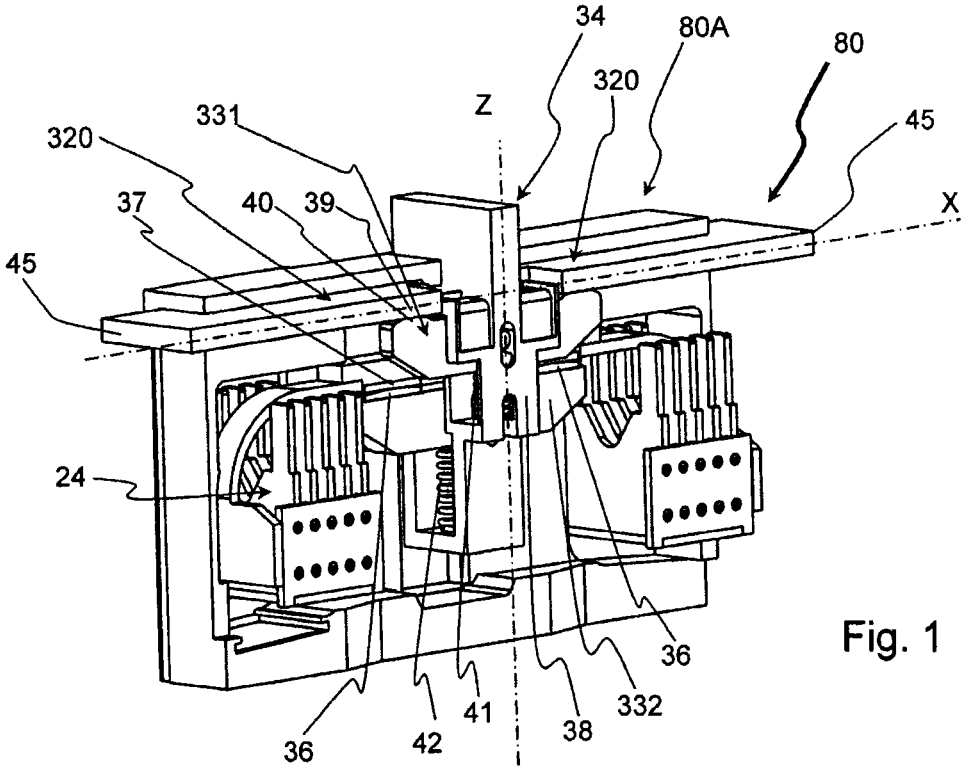
FIG. 1 shows a perspective view of a switching unit in a closed position of the power contacts, according to one embodiment of the invention.

As shown in FIG. 1, the single-pole switching unit 80 comprises a housing made from a molded plastic material in which electrical contacts are arranged. Preferably, the housing is made up of two half-shells 80A assembled to form a substantially parallelepiped assembly developing along a longitudinal plane XZ. The housing then includes two main surfaces positioned parallel to the median longitudinal plane XZ. Said housing further comprises two side surfaces, an upper surface and a lower surface.

In the case of a contactor, an electromagnet (not shown) acts on the actuating mechanism 34 to control the closing and opening of the electrical contacts.

Figure 2:
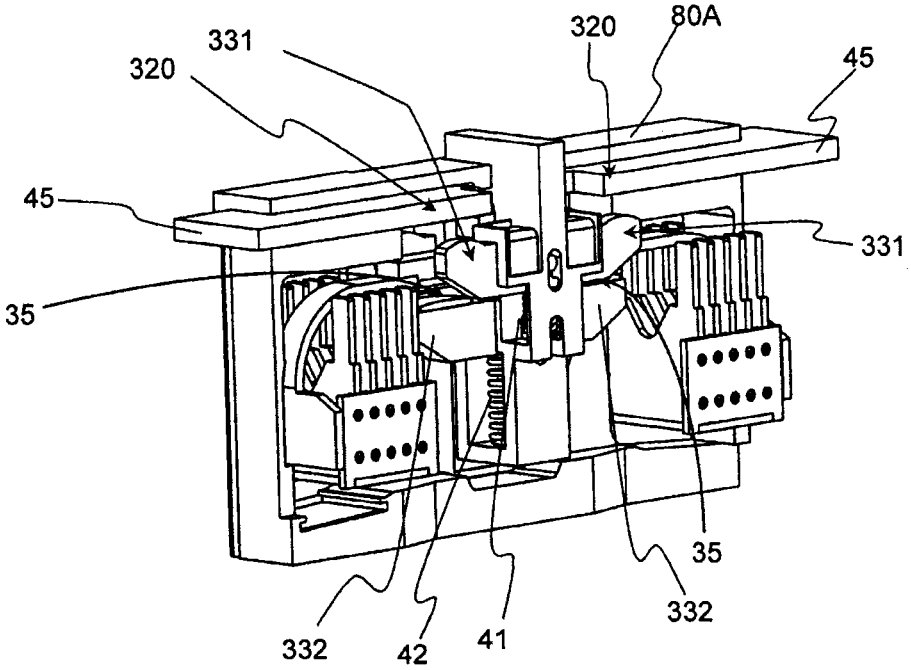
FIG. 2 shows a perspective view in an open position of the switching unit according to FIG. 1.
Figure 3A:
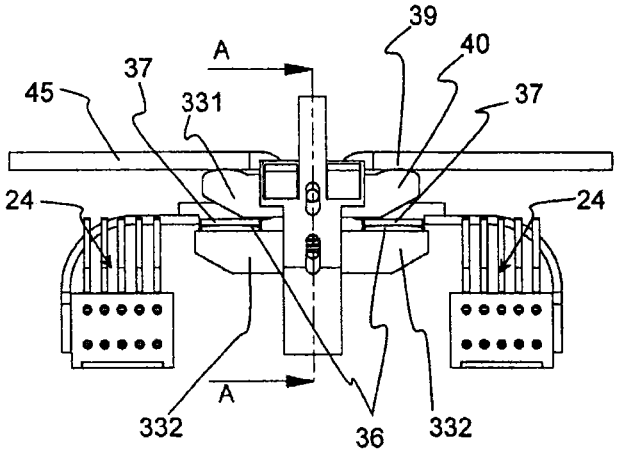
FIG. 3A shows a view of the switching means in a closed position of the power contacts, of a switching unit according to one embodiment of the invention.

According to one preferred embodiment of the invention as shown in FIGS. 1, 2 and 3A, the single-pole switching unit 80 comprises electrical switching means comprising two stationary contacts 320 respectively including electrical contact areas 37, 39. The switching means further include a moving contact 330 including a bridge having a body elongated along the longitudinal axis X and two ends respectively including contact areas 36, 40 able to cooperate with the contact areas 37, 39 of a stationary contact 320 in a closed position of the contacts 320, 330 of said unit. In the closed position, elastic means 41, 42, in particular such as helical springs, make it possible to provide sufficient contact pressure between the contact areas 36, 40 and 37, 39 to guarantee the passage of the current under good conditions.

Connection pads 45 respectively connect said stationary contacts 320 to an electrical terminal (not shown).

The movable contact bridge 330 can translate under the action of the actuating device 34. In fact, the actuating mechanism 34 controls the opening of the electrical contacts by translating the moving contact bridge 330 in a direction perpendicular to the longitudinal axis X. The moving contact bridge 330 moves between an open position and a closed position of the electrical contacts. The actuating device 34 of the moving contact 330 includes a moving contact holder 38.

Two opening volumes 35 are thus defined corresponding to the space in which the contact areas 37, 39 of a stationary contact 320 and the contact areas 36, 40 associated with the moving contact 330 are arranged.

According to one particular embodiment of the invention, each opening volume 35 may be associated with an arc-control device 24. Each arc-control device 24 opening onto the opening volume 35 is limited by two parallel side flanges placed on either side of the median longitudinal plane XZ. The two side flanges are positioned so as to surround a part of the moving bridge 330 during all of its movement between the open position and the closed position. In other words, the two side flanges are spaced apart from each other to allow the moving contact bridge 330 to move. The parallel side flanges of an arc-control device 24 may include inner surfaces covered with a gas-producing material.

Figure 6:
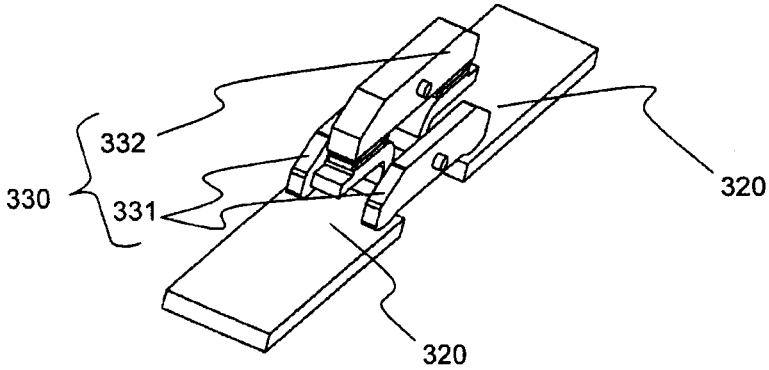
FIGS. 6 and 7 show detailed views of the stationary and moving contacts of a switching unit according to FIG. 1.
Figure 7:
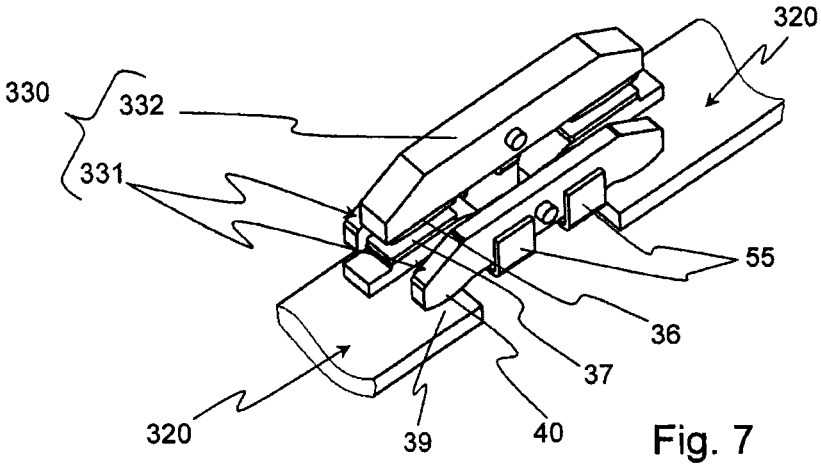

According to one preferred embodiment of the invention as shown in FIGS. 6 and 7, the moving contact 330 includes at least one first so-called current passage branch 331 and a second so-called electrical current switching branch 332. The first and second branches 331, 332 are designed to connect the two stationary contacts 320 in the closed position of the contacts 330, 320, respectively. Said at least one first passage branch 331 comprises two ends respectively including a contact area 40 able to collaborate with a contact area 39 of a stationary contact 320. Furthermore, the second switching branch 332 comprises two ends respectively including a contact area 36 able to cooperate with a contact area 37 of a stationary contact 320.

Figure 3B:
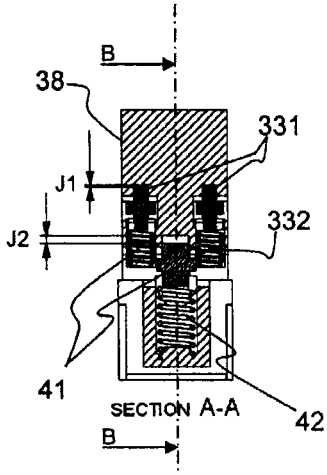
FIG. 3B shows a cross-sectional view of the switching means of the switching unit according to FIG. 3A.
Figure 4A:
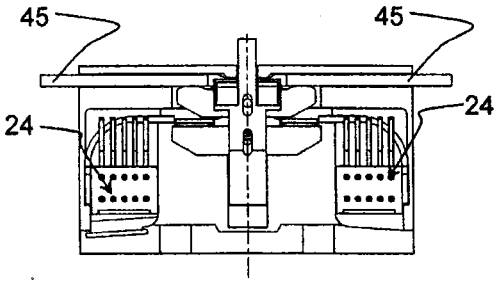
FIGS. 4A and 4B show cross-sectional views of switching means in an open position and a closed position, respectively, of a switching unit according to one embodiment of the invention.
Figure 4B:
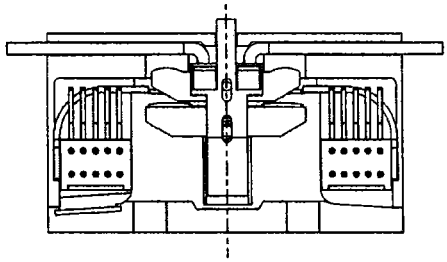
Figure 5A:
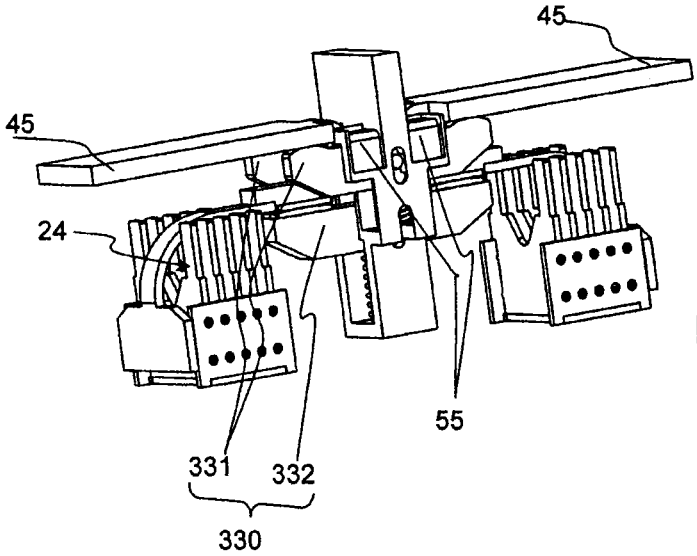
FIGS. 5A and 5B show perspective views of the switching means in closed and open positions, respectively, of a switching unit according to one embodiment shown in FIG. 1.

According to one particular embodiment of the invention, the moving contact 330 preferably includes two first passage branches 331 driven so as to go simultaneously from their open position to their closed position and vice versa. As shown in FIGS. 3B and 5A, said first branches 331 are positioned parallel to one another. This placement of the two first branches 331 in parallel (instead of only one first branch) makes it possible to pass a higher current in a given volume.

The first and second branches 331, 332 are movable relative to one another. Furthermore, the first and second branches 331, 332 are secured to the contact holder 38.

Thus, as an example embodiment, using two first passage branches 331 and one second switching branch 332 in parallel in a given volume makes it possible to obtain a 40% gain in the current-carrying capacity. This gain is estimated in comparison with a known contactor using a moving bridge with a single moving branch.

The aim of the invention is to prevent the contact areas 40 of the first branches 331 from being in contact with a switching arc during closing and/or opening of the electrical contacts 320, 330.

The fact that the first and second branches 331, 332 are movable relative to one another allows the fact that the first passage branches 331 are separated from the two stationary contacts 320 while the second switching branch 332 is still in contact with said stationary contacts 320 during opening of the contacts 330, 320 of said unit. Furthermore, the fact that the two branches 331, 332 are movable relative to one another allows the fact that the second branch 332 is in contact with the two stationary contacts 320, while the first branches 331 are still separated from the stationary contact 320 during closing of the contacts 330, 320 of said unit.

In other words, owing to the action of the moving contact holder 38, the first moving passage branches 331 and the second switching branches 332 move in an offset manner in the closing sequence of the contactor so as to close the second switching branch 332 first. Said first and second branches 331, 332 move in an offset manner in the opening sequence of the contactor so as to open the second switching branch 332 last. Thus, the contact areas 40 of the first passage branch 331 never experience an electric arc.

As shown in FIG. 3B, the time offset in the movement of the first and second branches 331, 332 is done owing to the relative positioning of said moving branches in the moving contact holder 38. When the electrical contacts 330, 320 are closed, a first operating play J1 separates the first passage branches 331 from the moving contact holder 38 and a second operating play J2 separates the second switching branch 332 from the moving contact holder 38. The relative sizing of the first and second plays J1, J2 makes it possible to obtain the time offset in the movement of the branches during the opening and closing of the electrical contacts 320, 330. Thus, according to this embodiment of the invention, the first operating play J1 is smaller than the second operating play J2 so that the passage branches 331 open first and close last.

According to one preferred embodiment of the invention as shown in FIG. 3B, the first branch 331 is translatably mounted on the moving contact holder 38 between two so-called contact pressure positions. A first contact pressure spring 41 applies a first contact pressure force F1. According to this example embodiment, each first branch 331 is translatably mounted on the moving contact holder 38 between two so-called contact pressure positions. A first contact pressure spring 41 applies a first contact pressure force F1 on each first branch 331.

According to this preferred embodiment of the invention, the second branch 332 is translatably mounted on the moving contact holder 38 between two so-called contact pressure positions, a second contact pressure spring 42 applying a second contact pressure force F2.

According to this preferred embodiment of the invention, the first branch 331 is designed for the passage of the nominal current (so-called normal operation), and the second passage branch 332 is intended to establish and interrupt electrical currents.

This architecture then makes it possible to optimize the sizing of each of the branches 331, 332 for the function for which it is intended.

Figure 8:
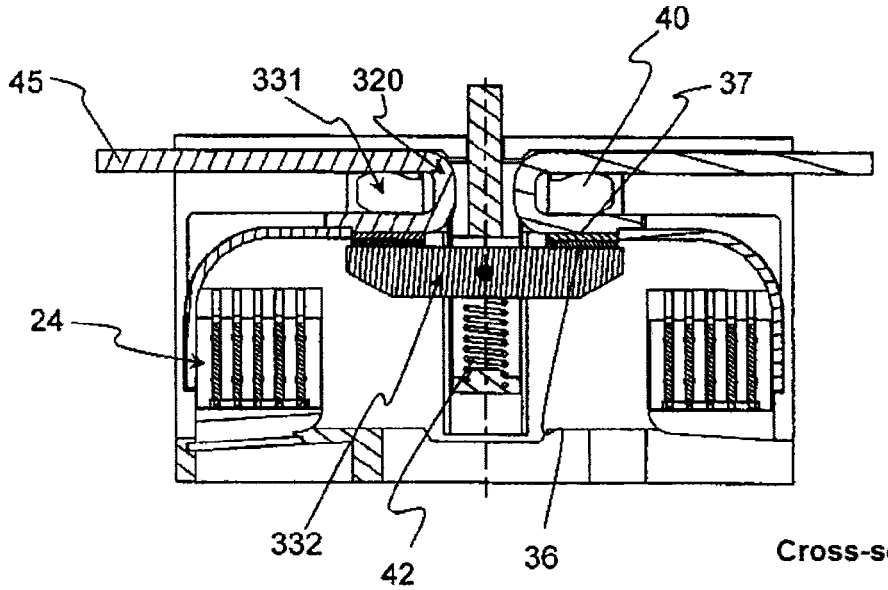
FIG. 8 shows a cross-sectional view of the switching means of a switching unit according to FIG. 3B.

In one example embodiment of the stationary contact 320, as shown in FIG. 8, the stationary contacts 320 intended to cooperate with the second switching branch 332 of the moving contact 330 are J-shaped at the contact areas 37 with the second branch 332. Thus, in the closed position of the contacts 320, 330, the direction of the electrical current circulating in a stationary contact 320 is opposite the direction of the electrical current circulating in the second branch 332. That is why this J shape is designed to favor the switching of the currents. Furthermore, the contact areas 37 of the stationary contact 320 designed to be in contact with the contact areas 36 of the second branch 332 include a contact pad. The contact areas 36 of the second branch 332 also include a contact pad. These pads are nevertheless small relative to those of a traditional contactor in light of the small number of switching operations.

The stationary contacts 320 designed to cooperate with the first branches 331 of the moving contact have a straight shape at the contact areas 39 with the first branch 331. Thus, in the closed position of the contacts 320, 330, the direction of the electrical current circulating in a stationary contact 320 is identical to the direction of the electrical current circulating in the first branch 331. That is why this straight shape is designed to greatly reduce the risks of electrodynamic repulsion. Furthermore, given that the contact areas 39 of the stationary contacts 320 placed across from the contact areas 40 of the first contact branches 331 of the moving contact 330 are not subject to alterations related to the electric arcs. Said areas 39, 40 are made up of copper covered with a fine layer of silver Ag or silver-carbon alloy AgC. A "fine layer" refers to a layer of material with a thickness for example comprised between 10 μm and several tens of microns. This in particular makes it possible to greatly reduce the volumes of silver of the contact pads present in the contactors. In this way, the consumption of a raw material, the reserves are becoming depleted, is greatly reduced, and the cost of the device is simultaneously decreased.

The first and second branches 331, 332 include substantially parallel longitudinal axes offset relative to one another in a movement direction Z of the moving contact 330. The translation of the moving contact holder 38 supporting the first and second branches 331, 332 is done in a direction perpendicular to the longitudinal axis X.

When the contactor is associated with a protective member of the fuse or circuit breaker type, if one wishes to guarantee correct operation of that product even after a high-level short circuit (50 to 100 kA), it is possible to add systems to the above architecture for compensating magnetic forces on the moving passage contacts. These systems, the purpose of which is to reinforce the closing forces of the contacts by using the current circulating therein itself, may assume different shapes depending on the caliber of the product, the most common of which is a U-shaped ferromagnetic part surrounding the first moving branches 331 and secured to the moving contact holder 38.

Figure 5B:
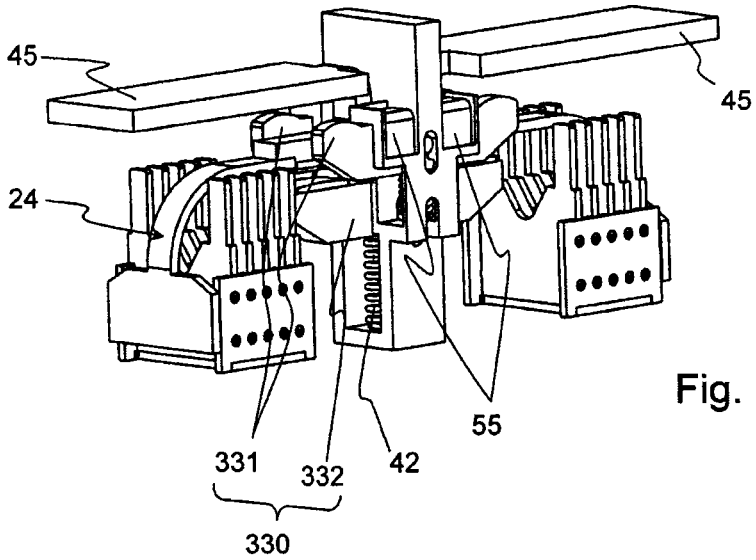

According to one alternative embodiment of the single-pole switching unit as shown in FIGS. 5B and 7, the moving contact holder 38 has a magnetic U 55 with two branches positioned such that they extend in the movement direction Z to surround at least part of the first branches 331.

Figure 9:
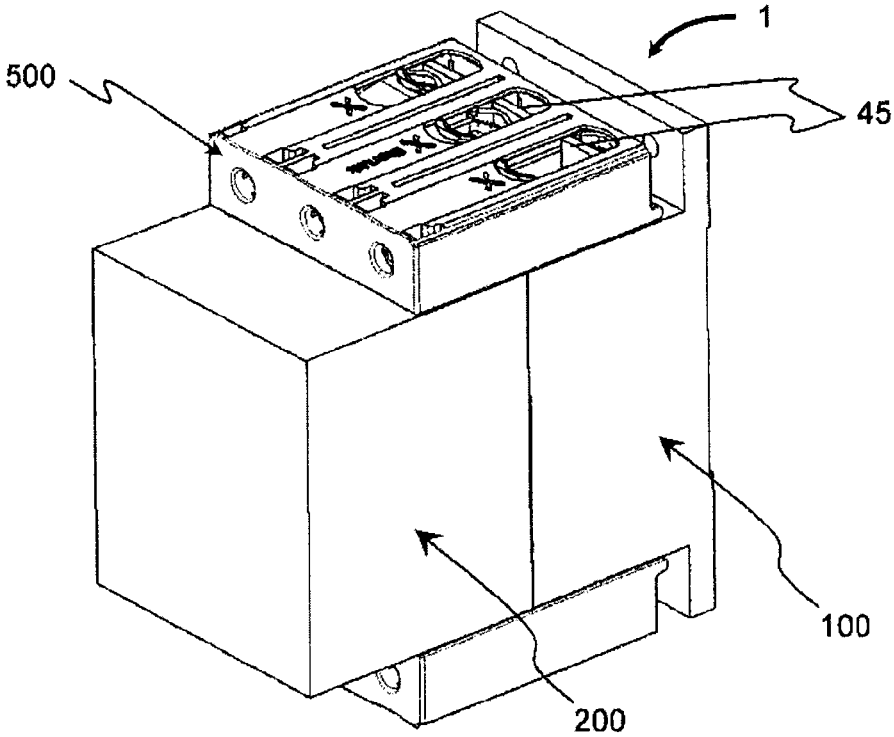
FIG. 9 shows a perspective view of a switchgear device according to one embodiment of the invention.

The invention also relates to a switchgear device 1, in particular such as a contactor. The electrical switchgear device 1 according to the invention as shown in FIG. 9 includes a phase unit 100 associated with an actuating unit 200. The phase unit 100 of the switchgear device 1 according to the invention includes one or more electric poles. According to the embodiment shown in FIG. 9, the contactor includes three electric poles, and is then called a three-pole switch. The unitary phase unit 80 is then associated with each electric pole. The three unitary phase units 80 are then controlled in a synchronized manner by the actuating unit 200 acting on the actuating devices 34 of the unitary phase units 80. The switchgear device 1 includes connecting terminal blocks 500 designed to be connected to the connection pads 45 of the unitary phase units 80.

The invention claimed is:

1. A single-pole switching unit comprising:

two stationary contacts respectively connected to an electrical pad for connecting to a unitary unit;

a moving contact including a bridge having a body elongated along a longitudinal axis and having two ends each configured to cooperate with the stationary contacts in a closed position of the stationary and moving contacts;

an actuator configured to actuate the moving contact including a moving contact holder;

the moving contact including two first current passage branches and a second current passage branch designed to connect the two stationary contacts in the closed position of the stationary and moving contacts, respectively, the first and second current passage branches being movable relative to one another such that:

the first current passage branches are separated from the two stationary contacts, while the second current passage branch is still in contact with said two stationary contacts when the stationary and moving contacts of said unit are opened;

the second current passage branch is in contact with the two stationary contacts, while the first current passage branches are separated from the two stationary contacts when the stationary and moving contacts are closed;

wherein the two stationary contacts are in the shape of a J at contact areas with the second current passage branch, such that, in the closed position of the stationary and moving contacts, the direction of the electrical current circulating in the two stationary contacts is opposite the direction of the electrical current circulating in the second current passage branch, and the two stationary contacts have a straight shape at contact areas with the first current passage branches, such that the direction of the electrical current circulating in the stationary contacts is identical to the direction of the electrical current circulating in the first current passage branches, the two first current passage branches are driven so as to go simultaneously from their open position to their closed position and vice versa, said first current passage branches being arranged parallel to one another, each of the first current passage branches being configured to connect with two different contact areas of the two stationary contacts.

2. The single-pole switching unit according to claim 1, wherein each of the first passage branches is mounted translatably on the moving contact holder between two contact pressure positions, a first contact pressure spring applying a first contact pressure force;

a second switching branch is mounted translatably on the moving contact holder movable between two contact pressure positions, a second contact pressure spring applying a second contact pressure force.

3. The single-pole switching unit according to claim 1, wherein the first and second current passage branches include substantially parallel longitudinal axes that are offset relative to one another in a movement direction of the moving contact, the movement being a translatable movement in a direction perpendicular to the longitudinal axes.

4. The single-pole switching unit according to claim 1, wherein each of the first current passage branches is mounted translatably on the moving contact holder between two contact pressure positions, a first contact pressure spring applying a first contact pressure force on each of the first current passage branches.

5. The single-pole switching unit according to claim 1, wherein the first and second current passage branches respectively comprise two ends each including a contact area configured to cooperate with a contact area of a respective stationary contact.

6. The single-pole switching unit according to claim 5, wherein the contact areas of the second current passage branch include a contact pad, and the contact areas of the respective stationary contact designed to be in contact with the contact areas of the second current passage branch include a contact pad.

7. The single-pole switching unit according to claim 5, wherein the contact areas of the first current passage branches and the contact areas of the respective stationary contact designed to be in contact with the contact areas of the first current passage branches are respectively covered with a layer of silver (Ag) or silver carbon (AgC).

8. The single-pole switching unit according to claim 1, wherein the moving contact holder includes a magnetic U having two branches arranged such that they extend in a direction of movement of the moving contact to surround at least part of the first current passage branches.

9. A switchgear device including a phase unit comprising at least one single-pole switching unit according to claim 1, the at least one single-pole switching unit controlled by an actuating unit acting on actuating devices of the at least one single-pole switching unit for synchronized control of the opening of the stationary and moving contacts.

* * * * *